US006866160B2

(12) United States Patent
Wang et al.

(10) Patent No.: US 6,866,160 B2
(45) Date of Patent: Mar. 15, 2005

(54) FOLDING STRUCTURE FOR FOLDABLE CONTAINER

(76) Inventors: Feng Wang, 5F, Financial Center, Shekou, Shenzhen (CN); Shisheng Wang, 5F, Financial Center, Shekou, Shenzhen (CN)

( * ) Notice: Subject to any disclaimer, the term of this patent is extended or adjusted under 35 U.S.C. 154(b) by 123 days.

(21) Appl. No.: 10/181,629

(22) PCT Filed: Jan. 16, 2001

(86) PCT No.: PCT/CN01/00058

§ 371 (c)(1),
(2), (4) Date: Nov. 4, 2002

(87) PCT Pub. No.: WO01/53173

PCT Pub. Date: Jul. 26, 2001

(65) Prior Publication Data

US 2003/0121918 A1 Jul. 3, 2003

(30) Foreign Application Priority Data

Jan. 21, 2000 (CN) ..... 00101741 A
Jan. 21, 2000 (CN) ..... 00202811 U

(51) Int. Cl.[7] ..... B65D 8/14

(52) U.S. Cl. ..... 220/7; 108/55.1; 108/56.1; 206/600; 220/1.5

(58) Field of Search ..... 220/1.5, 7, 4.28, 220/6; 108/55.1, 56.1; 206/600

(56) References Cited

U.S. PATENT DOCUMENTS 3,499,398 A * 3/1970 Murray ..... 108/53.5
4,131,071 A 12/1978 Glassmeyer
4,638,744 A * 1/1987 Clive-Smith ..... 108/56.1
4,964,349 A * 10/1990 Bishop ..... 108/55.1
5,755,472 A * 5/1998 Clive-Smith ..... 294/67.1
6,227,397 B1 * 5/2001 Kim ..... 220/8
6,277,397 B1 * 8/2001 Shimizu ..... 424/443

FOREIGN PATENT DOCUMENTS

GB 2 060 567 5/1981
GB 2 073 149 10/1981
GB 2 295 381 5/1986

* cited by examiner

*Primary Examiner*—Joseph C. Merek
(74) *Attorney, Agent, or Firm*—Merchant & Gould P.C.

(57) ABSTRACT

A folding structure for a foldable container having a base platform, bottom side rails disposed at both sides of the base platform, and corner posts disposed at both sides of the bottom rails. The corner posts are pivotally attached to the bottom side rails via pins and the sides of the corner posts are provided with corner post locking devices which can hold the corner posts in an upright position or a folded down position. The corner post locking device includes inner locking apertures arranged on both sides of the ends of the bottom side rails. Outer locking apertures are arranged on both sides of the lower ends of the corner posts which correspond to the inner locking apertures when the corner posts are in the upright position. Threaded taper pins are further provided which engage with the inner and outer locking apertures correspondingly.

23 Claims, 3 Drawing Sheets

FOLDING STRUCTURE FOR FOLDABLE CONTAINER

FIELD OF THE INVENTION

The present invention relates to field of container and, more specifically, to the structure for a foldable container, particularly to the folding related parts and the locking device structure.

BACKGROUND OF THE INVENTION

The folding structure and the locking device are the key parts of a foldable container. The corner posts facilitate the folding down of the folding structure by being able to rotate about the pins. The locking devices provide the container with the capability to carry loads by rigidly securing the corner posts and the supporting structure of the container when the corner posts are in an upright position.

There are many types of prior art folding structures and locking devices. One typical type of folding structure includes thick steel plate disposed on the lower ends of the corner posts, inserted in the supporting structure of the container and attached via pins, allowing itself to be folded down by having the corner posts rotated about the pins. This type of folding structure, however, either complicates the container structure for having to conduct special arrangement on the structure to make room for the folded down corner posts, or has to accept higher height and bulky size in transportation and storage empty of cargo for having to stack the folded corner posts upon the corresponding structure of the container. The locking device can be a taper pin or a square pin equipped with a hammer, which hammers the pin into the corresponding aperture of the corner post and the container structure, facilitates the close attachment of the corner post, the pin and the bottom side rail, and further provides a block to prevent the pin from going loose. But this type of locking device is too bulky and has to be disposed on the end of the container, thus prevents other structures from being arranged on the end of the container, and leaves few chance to reduce the end thickness of the container.

OBJECTS AND SUMMARY OF THE INVENTION

The object of the present invention is to provide the foldable container with a new type of folding structure which overcomes the disadvantages of prior art folding structures and locking devices. It offers a corner post locking device of simplified structure and reduced overall size, occupies little space at the end of the container and facilitates the thickness reduction of the ends of the base platform. It further reduces container folded height, simplifies container structure, allows other devices to be arranged on the end of the container and lowers the thickness of the end according to the designing needs by moving the locking device from the end of the container to the side of the corner post.

In accordance with the foregoing, the present invention discloses a folding structure for a foldable container consisting of a base platform, bottom side rails disposed on both sides of the base platform, and corner posts disposed at the ends of the bottom side rails; the corner posts are pivotally attached to the bottom side rails via pins, wherein the sides of the corner posts are further provided with corner post locking devices which can hold the corner posts in an upright position or a folded down position; the corner post locking device includes inner locking apertures arranged on both sides of the ends of the bottom side rails; outer locking apertures arranged on both sides of the lower ends of the corner posts which correspond to the inner locking apertures when the corner posts are in the upright position; and threaded taper pins are further provided which engage with the inner and outer locking apertures correspondingly.

According to the present invention, the both sides of the lower ends of the corner posts are further provided with outer locking apertures which correspond to the inner locking apertures when the corner posts are in a folded down position; and threaded taper pins are further provided which engage with the inner and outer locking apertures correspondingly.

According to the present invention, the cross section of the corner post is U-shaped, with the opening of the U-shaped cross section directed to the bottom side rails, and the inner size of its U-shaped cross section matches with the outer size of the bottom side rail. When the corner post is in a folded down position toward the bottom side rail, the corresponding section of the bottom side rail is in the U-shaped groove of the corner post.

The advantages of the present invention: in the present invention as described above, the locking pin is inserted into the locking aperture and rotated when the corner post is in the upright position. Under the help of the inner and outer threads, the locking pin drives the conical surface of the main part and the conical aperture engage closely as its proceeds, and works together with the pin to rigidly secure the inner and outer plates, thus rigidly secures the corner posts in the upright position. The most part of the locking device is in the inner and outer plates and leaves few section exposed outside. This type of locking device boasts of simple structure, little bulk, occupies no space on the end of the container, helps much in reducing the thickness of the end of the container supporting structure. Furthermore, the locking device boasts of easy operation and high reliability. The folding structure according to the present invention, thanks to the corner posts of U-shaped cross section and corner post locking devices, allows the two side panels of the corner posts to be directly attached to the two sides of the bottom side rails via pins. This forms a strong contrast against the prior art folding structure, which demands special treatment on the lower structure of the corner posts and the corresponding supporting structures of the frame, thus inevitably increases the complexity of the structure. The present invention simplifies structure and saves much space on the end of the foldable container. When the corner posts are in a folded down position, the corner posts buckle with the bottom side rails, requiring no additional space to house the corner posts, thus facilitates the significant height reduction of the folded corner posts.

DETAILED DESCRIPTION OF THE PREFERRED EMBODIMENT

Figure 5:
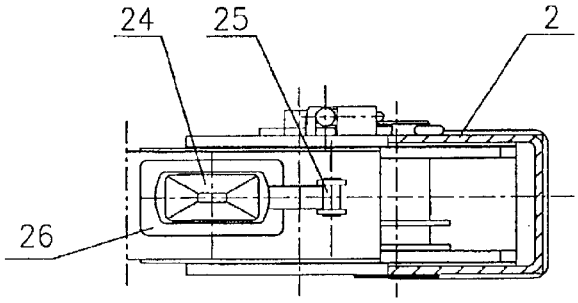
FIG. 5 is a view from direction F of FIG. 3.

As shown in FIG. 1, FIG. 2, FIG. 5 and FIG. 11, a folding structure for a foldable container of the present invention consists of a base platform 30, bottom side rails 1 disposed at both sides of the base platform 30, and corner posts 2 disposed at the ends of the bottom side rails 1; the corner posts 2 are pivotally attached to the bottom side rails 1 via pins 7. As shown in FIG. 5, being U-shaped in the cross section, the corner post 2 has an opening directed to the bottom side rail 1 and of an inner size matching with the outer size of the bottom side rail 1. When the corner post 2 is in a folded down position, the corresponding part of the bottom side rail 1 places itself in the U-shaped groove of the corner post 2. On the top of the corner post 2 is generally provided a corner fitting 31, which attaches the corner post 2 to a top beam 32, the corresponding part of the bottom side rail 1 to the corner fitting 31 is provided with a groove 30' which can house the corner fitting 31. When the corner post 2 is in a folded down position, the corner fitting 31 places itself in the groove 30'.

Figure 1:
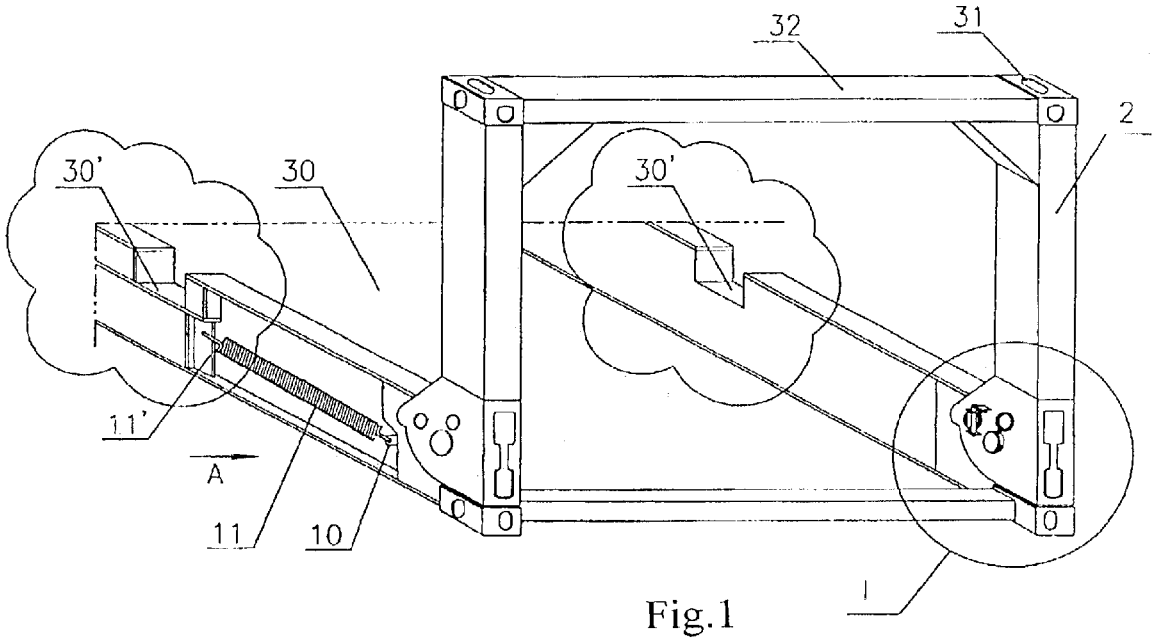
FIG. 1 is a perspective view of the end of a foldable container in a preferred embodiment with a folding structure according to the present invention.
Figure 2:
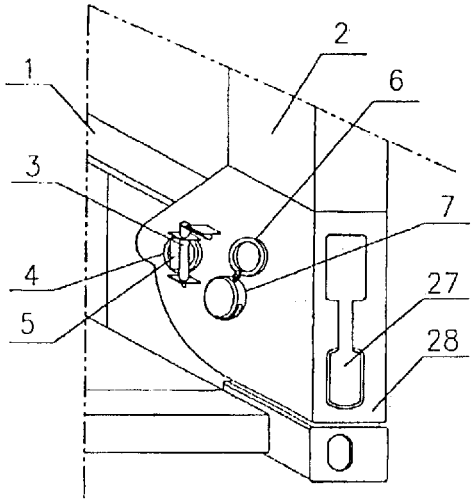
FIG. 2 is an enlarged view of part I in FIG. 1.
Figure 7:
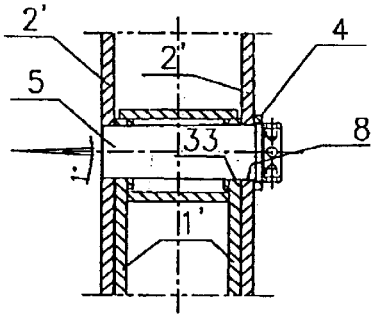
FIG. 7 is a C—C cutaway view of FIG. 3.

As shown in FIG. 2 and FIG. 7, the two sides of the ends of the bottom side rails 1 in the present preferred embodiment are provided with plates 1' attached to the bottom side rails 1. The two sides of the lower ends of the corner posts 2 are provided with plates 2' attached to the corner posts 2 and corresponding to the plates 1'. The plates 1' are provided with inner locking apertures 33 and the plates 2' are provided with outer locking apertures 8 which correspond to the inner locking apertures 33 when the corner posts 2 are in an upright position. Threaded taper pins 5 are further provided which engage with the inner and outer locking apertures correspondingly.

Figure 8:
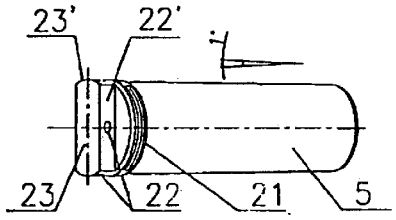
FIG. 8 is a perspective view of a taper pin 5.
Figure 9:
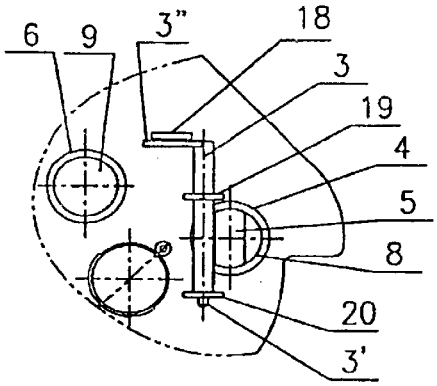
FIG. 9 is a view from direction E of FIG. 6.
Figure 10:
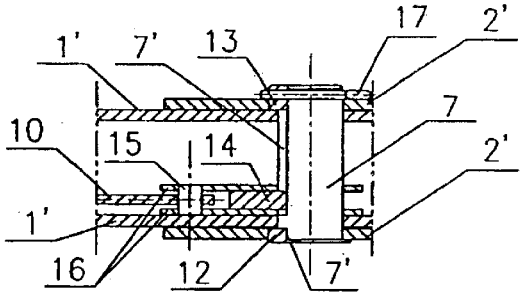
FIG. 10 is a D—D cutaway view of FIG. 3.
Figure 11:
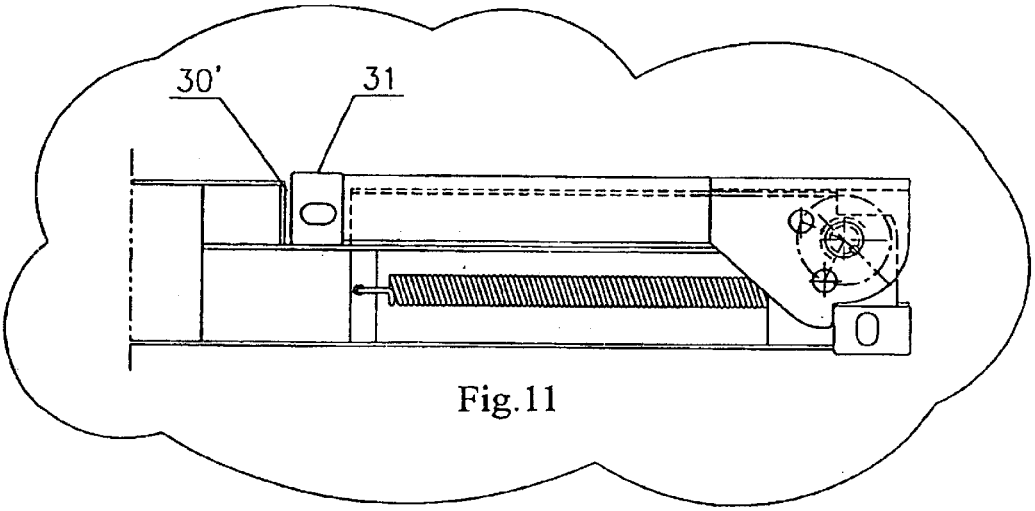
FIG. 11 is a view of a corner fitting 31 in the groove 30' when the corner posts 2 are in a folded down position.

As shown in FIG. 8 and FIG. 9, the main part of the taper pin 5 in the present preferred embodiment is in a conical form and the rear part is in a column form with outer threads 21. A locking ring 4 corresponding to the outer threads 21 is welded to the plate 2' on the position of the outer side of the plate 2' where the outer locking aperture 8 and the rear part of the taper pin 5 engage with each other. The end surface of the taper pin 5 is provided with a projection bar 23, whose side plane consists of plane 22' and column plane 23' which are perpendicular to the end surface of the taper pin 5, the plane 22' and the column plane 23' are provided with apertures 22 respectively; a handle 3 including at its lower end a projection head 3' corresponding to the aperture 22 is further provided. By the side of the locking aperture 8 are provided an upper handle carrying plate 19 and a lower handle carrying plate 20, both attached to the plate 2'. The carrying plate 19 is provided with an aperture which corresponds to diameter of the main part of the handle 3 while the carrying plate 20 is provided with an aperture which corresponds to the projection head 3'. The side of the upper end of the handle 3 is provided with a terminal plate 3" which is perpendicular to the handle 3, and the plate 2' is provided with a baffle 18 which corresponds to the terminal plate 3".

Figure 3:
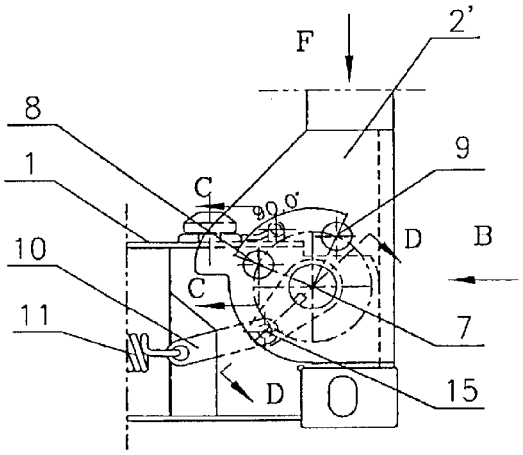
FIG. 3 is a local view from direction A of FIG. 1.
Figure 4:
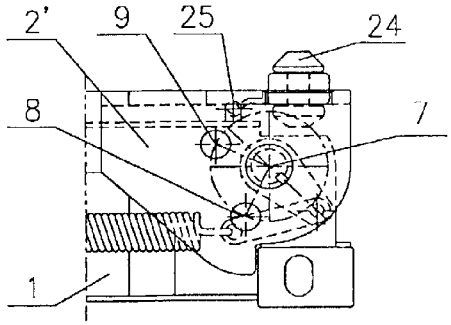
FIG. 4 is a local view from direction A when the corner posts are in a folded down position.

As shown in FIG. 2, FIG. 3 and FIG. 4, the plate 2' in the present preferred embodiment is provided with an outer locking aperture 9 which corresponds to the inner locking aperture when corner post 2 is in a folded down position. A locking ring 6 corresponding to the outer thread 21 and welded with the plate 2' is provided on the corresponding position of the outer side of the plate 2' where the outer locking aperture 9 and the taper pin 5 engage with each other.

Figure 6:
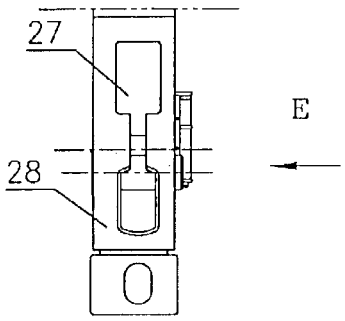
FIG. 6 is a view from direction B of FIG. 3.

As shown in FIG. 5 and FIG. 6, the inner sides of the ends of the bottom side rails 1 close to the corner posts 2 in the present preferred embodiment are provided with prior art twist locks 24 which are pivotally attached to the bottom side rails 1 via pins 25. The bottom plates 28 of the corner posts 2 are provided with apertures 27 which correspond to the twist locks 24. The twist lock 24 can rotate about the pin 25 and stays in the open aperture 26 of the bottom side rail 1 when the corner post 2 is in an upright position. The rigid locking of the foldable containers when they are stacked one upon another is facilitated by having the twist lock 24 rotated, gone through the open aperture 27 on the plate 28 and eventually stayed at the corresponding position of the plate 28 when the corner post 2 is in a folded down position.

As shown in FIG. 1, FIG. 3, FIG. 4 and FIG. 10, the pin 7 in the present preferred embodiment is provided with a groove 7', which is further provided with keys 13, 12 on two ends respectively, the key 12 is welded to the pin 7 at one end and extends into the corresponding groove of the plate 2' at the other end; the key 13 extends into the groove 7' at one end and the corresponding groove of the plate 2' at the other end; a pin 17 is further provided which goes through an aperture disposed on the front end of the pin 7 and perpendicular to the axis of the pin 7 and an open aperture disposed on the outer side of the key 13. The outer side of each end of every bottom side rail 1 is provided a spring 11. One end of the spring 11 is attached to the plate 11' welded with the bottom side rail 1 and the other end of the spring 11 is attached to the outer end of a rod 10, whose inner end is hinged to the pin 15. Both ends of the pin 15 are welded with one end of the plate rod 16, whose second end is provided with an aperture corresponding to the pin 7. The plate rod 16 and the pin 7 engage with each other between the two plates 1' of the bottom side rail 1; a key 14 is further provided, with one end extends into the groove 7' of the pin 7 and the other end positioned between and welded with the two plate rods 16. Being pulled all the time, the spring 11 passes the pulling force to the pin 15 and the plate rod 16 via the rod 10, and exerts a rotating torque to the pin 7 via the key 14 attached to the plate rod 16. Being passed to the corner post 2 via key 12 and key 13, the rotating torque drives the corner post 2 to rotate towards the upright position, thus easing the folding operation of the corner post 2.

In the folding structure of the present invention, the bottom side rail 1 of the container supporting structure places itself in the groove of the corner post 2, which rotates about the pin 7. When the corner post 2 is in an upright position, the corner post 2 and the bottom side rail 1 can be rigidly locked through the close engagement of the conical surface of the taper pin 5 and the conical aperture surface of the corner post 2 and the bottom side rail 1 by having the handle 3 inserted into the aperture 22 of the taper pin 5 and having the taper pin 5 rotated, which engages with the locking ring 4 provided with inner threads and welded with the corner post 2. The threads are common threads with sound and reliable self-locking capability. After that, the taper pin 5 can be prevented from being dropped from the locking ring 4 because of accidental load impact by having the handle 3 gone through the the plate 19 and placed on the plate 20 to engage the handle 3 with the end surface 22" of the taper pin 5. The handle 3 can also be prevented from being dropped from the plates 19, 20 with the handle terminal plate 3" and the plate 18 by having the terminal plate 3" rotated and restrained under the bottom side of the plate 18 so the projection head 3' of the lower end of the handle 3 will not exit the plate 20 automatically when the handle 3 has been inserted in place. In folding down, the handle 3 should be removed first, then have the taper pin 5 removed with the handle 3, then have the corner post folded down, at this time, the locking ring 6 welded to the corner post 2 happens to rotate to the inner locking aperture of the bottom side rail 1, have the corner post 2 and the bottom side rail 1 rigidly locked with the taper pin 5 by the handle 3 in the same way to facilitate the rigid attachment of the corner post 2 and the bottom side rail 1.

When the corner post 2 is in an upright position, the outer locking aperture 8 is locked rigidly and corresponds to the locking ring 4; when the corner post 2 is in a folded down position, the outer locking aperture 9 is rigidly locked and corresponds to the locking ring 6. Located in the same circumference centered at the pin 7, the locking aperture 8 and the locking aperture 9 form a right angle. When the corner post 2 is in a folded down position, the bottom side rail 1 happens to be in the U-shaped groove of the corner post 2, thus facilitates the thickness reduction of the folded structure.

What is claimed is:

1. A folding structure for a foldable container, consisting of a base platform, bottom side rails (1) disposed at both sides of the base platform, and corner posts (2) disposed at the ends of the bottom side rails (1); the corner posts (2) are pivotally attached to the bottom side rails (1) via pins (7), wherein the sides of the corner posts (2) are provided with corner post locking devices which can hold the corner posts in an upright position or a folded down position; wherein the corner post locking device consists of inner plates (1') disposed on both sides of the ends of the bottom side rails (1) and attached to the bottom side rails (1), outer plates (2') disposed on both sides of the lower ends of the corner posts (2) and attached to the corner posts (2) which correspond to the inner plates (1'); wherein the inner plates (1') are provided with inner locking apertures; and wherein the outer plates (2') are provided with outer locking apertures (8) which correspond to the inner locking apertures when the corner posts (2) are in a upright position; and threaded taper pins are further provided which engage with the inner and outer locking apertures correspondingly, wherein the cross section of the corner post (2) is U-shaped, with the opening of the U-shaped cross section toward to the bottom side rail, and the inner size of the cross section matches with the outer size of the bottom side rail (1), the corresponding section of the bottom side rail (1) is in the U-shaped groove of the corner post (2) when the corner post (2) is in a folded down position toward the bottom side rail (1).

2. A folding structure as claimed in claim 1 wherein in both sides of the lower ends of the corner posts (2) are provided with outer locking apertures (9) which correspond to the inner locking apertures when the corner posts (2) are in a folded down position, and threaded taper pins (5) are further provided which engage with the inner and outer locking apertures correspondingly.

3. A folding structure for a foldable container, consisting of a base platform, bottom side rails (1) disposed at both sides of the base platform, and corner posts (2) disposed at the ends of the bottom side rails (1); the corner posts (2) are pivotally attached to the bottom side rails (1) via pins (7), wherein the sides of the corner posts (2) are provided with corner post locking devices which can hold the corner posts in an upright position or a folded down position; wherein the corner post locking device consists of inner plates (1') disposed on both sides of the ends of the bottom side rails (1) and attached to the bottom rails (1), outer plates (2') disposed on both sides of the lower ends of the corner posts (2) and attached to the corner posts (2) which correspond to the inner plates (1'); wherein the inner plates (1') are provided with inner locking apertures; and wherein the outer plates (2') are provided with outer locking apertures (8) which correspond to the inner locking apertures when the corner posts (2) are in the upright position; and threaded taper pins are further provided which engage with the inner and outer locking apertures correspondingly, wherein one part of the taper pin (5) is in a conical form and the other part is in a column form with outer threads (21), the outer side of the outer plate (2') where the locking aperture (8) and the taper pin (5) engage with each other is provided with a locking ring (4) which corresponds to the outer threads (21) and welds with the outer plate (2').

4. A folding structure for a foldable container, consisting of a base platform, bottom side rails (1) disposed at both sides of the base platform, and corner posts (2) disposed at the ends of the bottom side rails (1); the corner posts (2) are pivotally attached to the bottom side rails (1) via pins (7), wherein the sides of the corner posts (2) are provided with corner post locking devices which can hold the corner posts in an upright position or a folded down position; wherein the corner post locking device consists of inner plates (1') disposed on both sides of the ends of the bottom side rails (1) and attached to the bottom rails (1), outer plates (2') disposed on both sides of the lower ends of the corner posts (2) and attached to the corner posts (2) which correspond to the inner plates (1'); wherein the inner plates (1') are provided with inner locking apertures; and wherein the outer plates (2') are provided with outer locking apertures (8) which correspond to the inner locking apertures when the corner posts (2) are in the upright position; and threaded taper pins are further provided which engage with the inner and outer locking apertures correspondingly, wherein the end surface of the taper pin (5) is provided with a projection bar (23), whose side is provided with a plane (22') and a column plane (23') which perpendicular to the end surface of the taper pin (5); the plane (22') and the column plane (23') are provided with apertures (22) respectively; a handle (3) is further provided, whose lower end is provided with a projection head (3') which corresponds to the aperture (22).

5. A folding structure as claimed in claim 4, wherein the side of the locking aperture (8) is provided with an upper handle carrying plate (19) and a lower handle carrying plate (20), both attached to the outer plates (2'); the carrying plate (19) is provided with an aperture which corresponds to the diameter of the main part of the handle (3), the carrying plate (20) is provided with an aperture which corresponds to the projection head (3').

6. A folding structure as claimed in claim 5, wherein the upper end of the handle (3) is provided with a terminal plate (3") which is perpendicular to the handle (3), and the outer plate (2') is provided with a baffle (18) which corresponds to the terminal plate (3").

7. A folding structure for a foldable container, consisting of a base platform, bottom side rails (1) disposed at both sides of the base platform, and corner posts (2) disposed at the ends of the bottom side rails (1); the corner posts (2) are pivotally attached to the bottom side rails (1) via pins (7), wherein the sides of the corner posts (2) are provided with corner post locking devices which can hold the corner posts in an upright position or a folded down position; wherein the corner post locking device consists of inner plates (1')

disposed on both sides of the ends of the bottom side rails (1) and attached to the bottom rails (1), outer plates (2') disposed on both sides of the lower ends of the corner posts (2) and attached to the corner posts (2) which correspond to the inner plates (1'); wherein the inner plates (1') are provided with inner locking apertures; and wherein the outer plates (2') are provided with outer locking apertures (8) which correspond to the inner locking apertures when the corner posts (2) are in the upright position; and threaded taper pins are further provided which engage with the inner and outer locking apertures correspondingly, wherein the outer side of the outer plate (2') where the outer locking aperture (9) and the taper pin (5) engages is provided with a locking ring (6) which corresponds to outer threads (21) and welds with the outer plate (2') as a whole.

8. A folding structure as claimed in claim 1, wherein the inner sides of the ends of the bottom side rails (1) close to the corner posts (2) are provided with twist locks (24), which are pivotally attached to the bottom side rails (1) via pins (25); and the bottom plates (28) of the corner posts (2) are provided with apertures (27) which correspond to the twist locks (24).

9. A folding structure for a foldable container, consisting of a base platform, bottom side rails (1) disposed at both sides of the base platform, and corner posts (2) disposed at the ends of the bottom side rails (1); the corner posts (2) are pivotally attached to the bottom side rails (1) via pins (7), wherein the sides of the corner posts (2) are provided with corner post locking devices which can hold the corner posts in an upright position or a folded down position; wherein the corner post locking device consists of inner plates (1') disposed on both sides of the ends of the bottom side rails (1) and attached to the bottom rails (1), outer plates (2') disposed on both sides of the lower ends of the corner posts (2) and attached to the corner posts (2) which correspond to the inner plates (1'); wherein the inner plates (1') are provided with inner locking apertures; and wherein the outer plates (2') are provided with outer locking apertures (8) which correspond to the inner locking apertures when the corner posts (2) are in the upright position; and threaded taper pins are further provided which engage with the inner and outer locking apertures correspondingly, wherein the pin (7) is provided with a groove (7'), which is further provided with keys (13, 12) on both ends, the keys (12) is welded to the pin (7) at one end and extended into the corresponding groove of the outer plate (2') at the other end; the key (13) extends into the groove (7') at one end and the corresponding groove of the outer plate (2') at the other end; an pin (17) is further provided which goes through an aperture disposed on the front end of the pin (7) and perpendicular to the axis of the pin (7) and an open aperture disposed on the outer side of the key (13).

10. A folding structure as claimed in claim 9, wherein both outer sides of the ends of the bottom side rails (1) are provided springs (11), the spring is attached to the plate (11') welded with the bottom side rail (1) at one end and to the outer end of the rod (10) at the other end, with the inner end of the rod (10) hinged to a pin (15), both ends of the pin (15) are welded with one end of the plate rods (16), the other end of the plate rods (16) are provided with an aperture which corresponds to the pin (7); the plate rod (16) and the pin (7) engage between the two inner plates (1') of the bottom side rail (1); a key (14) is further provided whose one end extends into the groove (7') of the pin (7), the other end is positioned between and welded with the two plate rods (16).

11. A folding structure as claimed in claim 1, wherein the proper position of the bottom side rail (1) is provided with a groove (30') which corresponds to a corner fitting (31) on top of the corner post (2), the corner fitting (31) happen to be placed in the groove when the corner post (2) is in a folded down position.

12. A folding structure as claimed in claim 3, wherein both sides of the lower ends of the corner posts (2) are provided with outer locking apertures (9) which correspond to the inner locking apertures when the corner posts (2) are in a folded down position, and threaded taper pins (5) are further provided which engage with the inner and outer locking apertures correspondingly.

13. A folding structure as claimed in claim 4, wherein both sides of the lower ends of the corner posts (2) are provided with outer locking apertures (9) which correspond to the inner locking apertures when the corner posts (2) are in a folded down position, and threaded taper pins (5) are further provided which engage with the inner and outer locking apertures correspondingly.

14. A folding structure as claimed in claim 7, wherein both sides of the lower ends of the corner posts (2) are provided with outer locking apertures (9) which correspond to the inner locking apertures when the corner posts (2) are in a folded down position, and threaded taper pins (5) are further provided which engage with the inner and outer locking apertures correspondingly.

15. A folding structure as claimed in claim 9, wherein both sides of the lower ends of the corner posts (2) are provided with outer locking apertures (9) which correspond to the inner locking apertures when the corner posts (2) are in a folded down position, and threaded taper pins (5) are further provided which engage with the inner and outer locking apertures correspondingly.

16. A folding structure as claimed in claim 3, where in the inner sides of the ends of the bottom side rails (1) close to the corner posts (2) are provided with twist locks (24), which arc pivotally attached to the bottom side rails (1) via pins (25); and the bottom plates (28) of the corner posts (2) are provided with apertures (27) which correspond to the twist locks (24).

17. A folding structure as claimed in claim 4, where in the inner sides of the ends of the bottom side rails (1) close to the corner posts (2) are provided with twist locks (24), which are pivotally attached to the bottom side rails (1) via pins (25); and the bottom plates (28) of the corner posts (2) are provided with aperture (27) which correspond to the twist locks (24).

18. A folding structure as claimed in claim 7, wherein the inner sides of the ends of the bottom side rails (1) close to the corner posts (2) are provided with twist locks (24), which are pivotally attached to the bottom side rails (1) via pins (25); and the bottom plates (28) of the corner posts (2) are provided with apertures (27) which correspond to the twist locks (24).

19. A folding structure as claimed in claim 9, wherein the inner sides of the ends of the bottom side rails (1) close to the corner posts (2) are provided with twist lock (24), which are pivotally attached to the bottom side rails (1) via pins (25); and the bottom plates (28) of the corner posts (2) are provided with apertures (27) which correspond to the twist locks (24).

20. A folding structure as claimed in claim 3, wherein the proper position of the bottom side rail (1) is provided with a groove (30') which corresponds to a corner fitting (31) on top of the corner post (2), the corner fitting (31) happen to be placed in the groove when the corner post (2) is in a folded down position.

21. A folding structure as claimed in claim 4, wherein the proper position of the bottom side rail (1) is provided with a groove (30') which corresponds to a corner fitting (31) on top of the corner post (2), the corner fitting (31) happen to be placed in the groove when the corner post (2) is in a folded down position.

22. A folding structure as claimed in claim 7, wherein the proper position of the bottom side rail (1) is provided with a groove (30') which corresponds to a corner fitting (31) on top of the corner post (2), the corner fitting (31) happen to be placed in the groove when the corner post (2) is in a folded down position.

23. A folding structure as claimed in claim 9, wherein the proper position of the bottom side rail (1) is provided with a groove (30') which corresponds to a corner fitting (31) on top of the corner post (2), the corner fitting (31) happen to be placed in the groove when the corner post (2) is in a folded down position.

* * * * *